US005415231A

United States Patent [19]

Northrop et al.

[11] Patent Number: 5,415,231

[45] Date of Patent: May 16, 1995

[54] METHOD FOR PRODUCING LOW PERMEABILITY RESERVOIRS USING STEAM

[75] Inventors: Paul S. Northrop; Robert S. Timmer, both of Bakersfield, Calif.

[73] Assignee: Mobil Oil Corporation, Fairfax, Va.

[21] Appl. No.: 210,488

[22] Filed: Mar. 21, 1994

[51] Int. Cl.[6] ..... E21B 43/24; E21B 43/26

[52] U.S. Cl. ..... 166/303; 166/308

[58] Field of Search ..... 166/303, 272, 263, 308

[56] References Cited

U.S. PATENT DOCUMENTS

| | | | |
|---|---|---|---|
| 3,490,527 | 1/1970 | Cook et al. | 166/245 |
| 3,739,852 | 6/1973 | Woods et al. | 166/303 |
| 5,085,276 | 2/1992 | Rivas et al. | 166/303 |
| 5,247,993 | 9/1993 | Sarem et al. | 166/303 |
| 5,305,829 | 4/1994 | Kumar | 166/245 |
| 5,325,920 | 7/1994 | Djabbarah | 166/303 X |

OTHER PUBLICATIONS

"Steam Stimulation Heavy Oil Recovery at Cold Lake, Alberta" SPE 7994; Ventura, Calif., Apr. 18–20, 1979.

*Primary Examiner*—Stephen J. Novosad

*Attorney, Agent, or Firm*—Alexander J. McKillop; George W. Hager, Jr.

[57] ABSTRACT

A method for recovering hydrocarbons (e.g. oil) from a low permeability subterranean reservoir of the type comprised primarily of diatomite. A first slug or volume of a heated fluid (e.g. 60% quality steam) is injected into the reservoir at a pressure greater than the fracturing pressure of the reservoir. The well is then shut in and the reservoir is allowed to soak for a prescribed period (e.g. 10 days or more) to allow the oil to displaced by the steam into the fractures by imbibition. The well is then produced until the production rate drops below an economical level. A second slug of steam is then injected and the cycles are repeated with the volume of each subsequent slug of steam being progressively smaller that the one before it (i.e. about 80%) and the respective soak period being increased by about 20% over that of the previous cycle.

13 Claims, No Drawings

METHOD FOR PRODUCING LOW PERMEABILITY RESERVOIRS USING STEAM

TECHNICAL FIELD

The present invention relates to the production of fluids from low permeability reservoirs and in one of its aspects relates to an imbibition method for producing connate fluids (e.g. hydrocarbons) from a low permeability reservoir (e.g. diatomite) by cyclically injecting steam in decreasing amounts.

BACKGROUND ART

Substantial reserves of hydrocarbons (e.g. oil) are known to exist in reservoirs which have very low permeabilities. For example, billions of barrels of oil of proven reserves are known to be trapped in diatomaceous reservoirs in California, alone. A diatomaceous reservoir (i.e. formed primarily of diatomite) is characterized by high porosity, high compressibility, and very low permeability (e.g. as low as 0.1 millidarcy) which makes the recovery of the oil from these reservoirs extremely difficult.

Several methods have been proposed and/or used for producing these low permeability reservoirs. For example, routine, secondary-production techniques (e.g. water and/or gas floods, steam stimulation, etc.) are often used but due to the low permeability and the absence of any substantial natural fracture network in diatomaceous reservoirs, it is difficult to establish the necessary flow of the drive fluid through the reservoir. Of course, these reservoirs may be hydraulically fractured to improve the permeabilities thereof. However, due to the subsidence/compaction characteristics of diatomaceous reservoirs, the hydraulically-induced fractures along with the natural fractures have a tendency to close as fluids are withdrawn from the reservoir, thereby again substantially decreasing the permeability of the formation long before the recovery operation is completed.

Another technique for producing low permeable reservoirs is one which is known as "imbibition". In an imbibition waterflood, the natural or induced fracture network in the reservoir is flooded with water but, unlike a conventional waterflood, there is no co-current flow of water and oil through the rock matrix. In other words, the water does not push the oil ahead of it so there is no flow of oil and water through the formation in the same direction. Instead, capillary action causes water in the fractures to soak or imbibe into the matrix through the fracture face.

The oil displaced by this water, in turn, flows from the matrix into the fracture through the same fracture face by means of countercurrent flow. The displaced or exchanged oil is then produced from the fracture network by excess water flowing therethrough. For a further description and discussion of "imbibition", see U.S. Pat. No. 3,490,527, incorporated herein by reference. Recently, an imbibition process carried out in a specialized fracturing pattern has been proposed for increasing the production from diatomaceous reservoirs, see commonly-assigned, U.S. patent application Ser. No. 08/142,028, filed Oct. 28, 1993now U.S. Pat. No. 5,3777,756.

Further, cyclic injection of steam has been used for the recovery of heavy oil. However, it has usually been used in formations that are generally unconsolidated and having high permeabilities since it is difficult for the steam to penetrate any substantial distances into low permeable reservoirs such as those formed of diatomite. Further, where there is extremely viscous oil in some unconsolidated formations, high pressure steam has been used to fracture the formation to increase the rate of heat input into the reservoir, see "STEAM STIMULATION HEAVY OIL RECOVERY AT COLD LAKE, ALBERTA", R. S. Buckles, SPE 7994, Ventura, Calif., Apr. 18–20, 1979. However, in these known steam recovery operations, imbibition is not an important recovery mechanism.

SUMMARY OF TEE INVENTION

The present invention provides a method for recovering hydrocarbons (e.g. oil) from a low permeability subterranean reservoir of the type comprised primarily of diatomite. A first slug or volume of a heated fluid (e.g. preferably high quality steam) is injected through a wellbore and into the reservoir at a pressure greater than the fracturing pressure of the reservoir. Injection of the heated fluid under these conditions creates a fracture in the reservoir that does not need to be propped. The first volume should be great enough to fill the fractures in the reservoir to provide as much heat to the reservoir as possible and up to the limiting rate of heat transfer at the solid side of the fracture face.

After the first volume or slug of heated fluid is injected, the wellbore is shut in and the reservoir is allowed to soak for a prescribed period (e.g. 10 days or more). The heated fluid condenses on the fracture faces to heat the reservoir immediately adjacent to the fracture faces. This reduces the viscosity of the oil and increases the wettability of the rock matrix, thereby increasing the rate of "imbibition" which is the primary mechanism involved in the production of the oil into the fractures. In other words, the heated fluid (i.e. condensed steam, hot water, etc.) in the fracture imbibes into the water-wet matrix thereby countercurrently expelling oil into the fractures.

At the end of the soak period, the well is opened and put on production. As the pressure in the reservoir is reduced during the production period, the unpropped fracture begins to close thereby pushing fluids out of the fracture towards the wellbore. The expelled reservoir fluids are produced from the fractures and through the wellbore until the production rate drops below an economical level. At the end of the production period and before commencing the next cycle, it may be necessary to clean out the wellbore to remove sand or the like.

Next, a second slug of heated fluid is injected which reopens the main fracture as well as other natural or newly-induced fractures. The hot water or condensed steam again provides the fluid to be imbibed into the matrix. The well is then soaked and produced as described above, completing the cycle. After this, a third slug of heated fluid may be injected and so on. The volume of each subsequent slug of steam is progressively smaller then the one before it (i.e. about 80% of the previous slug) and this may be continued until the volume of the slug to be injected approaches the volume of the main, open fracture in the reservoir. The soak period of each cycle, on the other hand, is increased by about 20% over that of the previous cycle since the temperature gradient at the fracture face will be decreasing with time, resulting in a slower rate of heat transfer.

BEST KNOWN MODE FOR CARRYING OUT THE INVENTION

The present invention is carried out through a typical wellbore has been drilled and completed from the surface into a low permeability reservoir, e.g. a diatomaceous reservoir. A diatomaceous reservoir (i.e. formed primarily of diatomite) is capable of containing large volumes of valuable connate fluids (e.g. hydrocarbons-/oil) but is characterized by high porosity, high compressibility, and very low permeability (e.g. as low as 0.1 millidarcy) which makes the recovery of the fluids from these reservoirs extremely difficult.

The wellbore is typically cased throughout its length with a casing which, in turn, is normally cemented in place. The casing, in turn, is normally perforated along a linear portion which lies adjacent the production zone of the reservoir to establish fluid communication between the wellbore and the reservoir formation. As used herein, "reservoir" and "formation" may be used interchangeably when referring to the completed or production zone with the wellbore.

After the wellbore has been completed, a first slug or volume of a heated fluid is injected through the wellbore and into the reservoir at a pressure greater than the fracturing pressure of the reservoir. Steam is the preferred heated fluid because of its high heat content per unit mass as well as its high rate of heat transfer associated with condensation with the condensed steam providing the vehicle for imbibition. However, hot water (i.e. 0% steam) can be used in diatomaceous formations containing light oil.

When steam is the heated fluid, the quality of the steam should be relatively high, e.g. greater than about 60%. Injection of the steam under these conditions creates a fracture in the reservoir that does not need to be propped. By not having to prop the fractures, the cost of the recovery operation is significantly reduced.

The volume of the first slug should be large enough to fracture and fill both the induced and natural fractures within the reservoir with steam. This volume may be calculated from the known characteristics and properties of the particular reservoir being produced. The main consideration in determining this volume is to provide as much heat into the reservoir as possible up to the limiting rate of heat transfer at the solid side of the fracture face. More specificially, the approximate size of the first volume can be arrived at by using the following simplified heat balance equation:

$$Q_t = V_s H_s = C V_r T$$

wherein:

$Q_t$=Total heat in Btu $V_s$=Volume of first slug of steam in barrels (bbls)

$H_s$=Enthalpy or heat content of steam (Btu/bbl)

C=Heat capacity of reservoir (Btu/ft$^3$)

$V_r$=Volume of reservoir heated=4 Lhd

4=number of fracture faces

L=Length of fracture in feet h=height of completion zone or interval in feet d=depth of penetration from fracture face $T = T_f - T_o$ $T_f$=Average temperature of adjacent reservoir after steam injection $T_o$=Average temperature of adjacent reservoir prior to steam injection Using the above relationships in a typical reservoir wherein $H_s$=295,000 Btu/bbl.; L=300 ft; d=4 ft.; (C=35 Btu/ft$^3$); and T=100° F., the first volume of steam ($V_s$) is found to be about 57 bbls./ft. of interval h. This can be rounded upward to approximately 60 bbls./ft. to insure sufficient steam is injected in this example.

After the first volume or slug of heated fluid (e.g. steam) is injected, the wellbore is shut in and the reservoir is allowed to soak for a prescribed period. The soak time is normally based on experience relating to the known parameters of the particular reservoir. While this time may vary depending on a specific situation, it should be no less than 10 days.

The basic purpose of injecting a large volume of steam as a first slug in the present invention is to generate a large fracture(s) into the formation and to allow the steam to condense on the fracture faces, thereby heating the reservoir immediately adjacent the fracture faces. The benefits of this are twofold: 1) it reduces the viscosity of the hydrocarbons in the rock matrix; and 2) it increases the wettability of the rock matrix, thereby resulting in greater rates of production due to imbibition. Still another potential benefit is that it expels solution gas from the heated oil which may push more oil into the fractures. In other words, the condensed steam in the fracture imbibes into the water-wet matrix thereby countercurrently expelling oil into the fractures.

After the reservoir has undergone its soak period, the well is opened and put on production. As the pressure in the reservoir is reduced during the production period, the unpropped fracture begins to close thereby pushing fluids out fracture towards the wellbore. The imbibed reservoir fluids are produced from the fractures and through the wellbore until the rate of hydrocarbon production drops below an economical level. At the end of the production period and before commencing the next cycle, it may be necessary to clean out the wellbore to remove siliceous and/or other material which may have been produced into the wellbore along with the fluids.

Next, a second slug of steam is injected and the complete cycle is repeated after which a third slug of steam may be injected and so on. The volume of each subsequent slug of steam is progressively smaller than the one before it and this may be continued until the volume of the slug to be injected approaches the volume of the fracture in the reservoir. As the area around the fracture faces heats up, it becomes more and more difficult for heat to be conducted further out into the formation. Accordingly, excessive volumes of steam (i.e. all volumes equal to that of the first volume) would result in wasted heat and would unnecessarily add substantially to the costs of the recovery operation.

More specifically, in each subsequent cycle of the present invention, approximately 80% of the previous volume of steam is injected into the reservoir. That is, a second slug of steam having a volume equal to approximately about 80% of the first volume is injected into the reservoir. Less steam is required during each successive cycle because of the heat already imparted to the reservoir by the previous cycle(s). The soak period of each cycle, on the other hand, is increased by about 20% over that of the previous cycle since the temperature gradient at the fracture face will be decreasing with time, resulting in a slower rate of heat transfer. Also, oil that is countercurrently expelled will have further to travel from its original place in the matrix to the fracture than did the previously displaced oil.

The cycles of the recovery operation are repeated with successive smaller amounts of steam being injected until the volume of steam approaches the volume of the fracture in the reservoir (e.g. estimated with tiltmeter surveys or the like). At this point, the injected volume may be insufficient to completely fill the entire fracture so preferably, the minimum volume of a slug of steam is always at least about 1.5 times or 50% more than the fracture volume as estimated.

What is claimed is:

1. A method for recovering hydrocarbons from a low permeability, subterranean reservoir, said method comprising:

providing a wellbore into said reservoir;

injecting a first volume of heated fluid through said wellbore and into said reservoir at a pressure above the fracture pressure of said reservoir;

shutting in said wellbore and allowing said reservoir to soak for a first period of time;

opening said wellbore and producing said reservoir therethrough until the production of hydrocarbons declines below a desired limit;

injecting a second volume of heated fluid through said wellbore and into said reservoir, said second volume of heated fluid is equal to about 80% of said first volume of heated fluid;

shutting in said wellbore and allowing said reservoir to soak for a second period of time wherein said second period of time is equal to at least about 120% of said first period of time; and opening said wellbore and producing said reservoir therethrough until the production of hydrocarbons again declines below a desired limit.

2. The method of claim 1 wherein said second volume of heated fluid is injected at a pressure above the fracturing pressure of the reservoir.

3. The method of claim 1 wherein said heated fluid is steam.

4. The method of claim 3 wherein the quality of said steam is at least about 60%.

5. The method of claim 3 including:

injecting a third volume of steam through said wellbore and into said reservoir, said third volume of steam is equal to about 80% of said second volume of steam;

shutting in said wellbore and allowing said reservoir to soak for a third period of time;

opening said wellbore and producing said reservoir therethrough until the production of hydrocarbons again declines below a desired limit.

6. The method of claim 5 wherein said third period of time is equal to about 120% of said second period of time.

7. The method of claim 6 wherein said third volume of steam is injected at a pressure above the fracturing pressure of the reservoir.

8. The method of claim 7 wherein said first period of time is at least 10 days.

9. The method of claim 3 including:

injecting additional volumes of steam into said reservoir;

shutting in said wellbore after each of said additional volumes of steams is injected and allowing the reservoir to soak for a prescribed period of time; and opening said wellbore after each prescribed period of time and producing said reservoir therethrough until the production of hydrocarbons again declines below a desired limit; wherein each of said additional volume of steam is equal to about 80% of the preceeding volume.

10. The method of claim 9 wherein:

each of said additional volumes of steam is equal to at least 50% more than the fracture volume in said reservoir.

11. The method of claim 3 wherein said first volume of steam is equal to about 60 barrels of steam for each completed foot of reservoir lying adjacent said wellbore.

12. The method of claim 1 wherein said heated fluid is hot water.

13. The method of claim 1 including:

cleaning debris from the wellbore before the injection of said second volume of heated fluid.

* * * * *